US006632064B1

(12) United States Patent
Walker et al.

(10) Patent No.: US 6,632,064 B1
(45) Date of Patent: Oct. 14, 2003

(54) METHOD AND APPARATUS TO MITIGATE NOISE DURING UNLOADING OF REFUSE CONTAINERS

(75) Inventors: Steve Walker, Vancouver, WA (US); John d'Arc Lorenz, Seattle, WA (US)

(73) Assignee: American Container and Recycling, Incorporated, Seattle, WA (US)

( * ) Notice: Subject to any disclaimer, the term of this patent is extended or adjusted under 35 U.S.C. 154(b) by 0 days.

(21) Appl. No.: 10/063,422

(22) Filed: Apr. 22, 2002

Related U.S. Application Data

(60) Provisional application No. 60/301,865, filed on Jun. 29, 2001.

(51) Int. Cl.[7] ..... B66F 9/12; B66F 9/18; B66F 1/00; B66F 1/14

(52) U.S. Cl. ..... 414/406; 414/408; 414/607; 414/785; 220/908; 294/68.26

(58) Field of Search ..... 414/785, 607, 414/406, 408; 220/908; 294/68.26

(56) References Cited

U.S. PATENT DOCUMENTS

| | | | | |
|---|---|---|---|---|
| 2,228,201 A | | 1/1941 | Cotes et al. | |
| 2,282,201 A | | 5/1942 | Neuman | |
| 2,817,792 A | * | 12/1957 | Chew | 414/785 |
| 3,692,335 A | | 9/1972 | Vickers et al. | |
| 3,850,111 A | | 11/1974 | Hansen | |
| 3,944,092 A | | 3/1976 | Ebeling et al. | |
| 4,090,626 A | | 5/1978 | Ebeling et al. | |
| 4,141,459 A | | 2/1979 | Eli, Jr. | |
| 4,331,214 A | | 5/1982 | Darby | |
| 4,550,849 A | * | 11/1985 | Adsit | 220/908 |
| 4,708,576 A | | 11/1987 | Conley | |
| 4,886,411 A | | 12/1989 | Pieperhoff et al. | |
| 5,230,600 A | | 7/1993 | Marino | |
| 5,330,071 A | | 7/1994 | Parker | |
| 5,490,606 A | * | 2/1996 | Lombardo | 220/908 |
| 5,575,608 A | | 11/1996 | Yau et al. | |
| 6,332,745 B1 | | 12/2001 | Duell et al. | |

FOREIGN PATENT DOCUMENTS

| | | |
|---|---|---|
| DE | 3710136 | * 10/1988 |
| DE | 4430728 | * 5/1996 |
| DE | 19634709 | * 3/1998 |
| JP | 8151198 | * 6/1996 |
| WO | 00/15538 | * 3/2000 |

* cited by examiner

*Primary Examiner*—Steven A. Bratlie
(74) *Attorney, Agent, or Firm*—Seed Intellectual Property Law Group PLLC

(57) ABSTRACT

The invention is directed to methods, apparatus and systems for retrofitting existing containers for use with vehicles having lifting forks for elevating and maneuvering such containers, and retrofitting the vehicle forks, as well as constructing new equipment to include the invention. An apparatus according to the invention includes a liner formed from a vibration absorbing material for insertion into a pocket associated with a container. Alternatively to or in conjunction with the liner, either a glove formed from a vibration absorbing material can be inserted over a lifting fork on a fork bearing, lifting apparatus, or a rail formed from a vibration absorbing material can be fitted to at least a portion of a lifting fork on the fork bearing, lifting apparatus. The invention is also directed to methods relating to the use and incorporation of the apparatus, and systems incorporating more than one component thereof.

37 Claims, 5 Drawing Sheets

METHOD AND APPARATUS TO MITIGATE NOISE DURING UNLOADING OF REFUSE CONTAINERS

BACKGROUND OF THE INVENTION

1. Field of the Invention

The present invention relates to the field of noise suppression, and more particularly to methods, apparatus and systems for retrofitting existing refuse containers and hauling systems to reduce noise during unloading of such containers, as well as constructing new equipment to incorporate the invention.

2. Description of the Related Art

Presently, commercial refuse containers are constructed from steel and come in a variety of form factors, the most prevalent being 3 and 4 cubic yard sizes. Early advancements in the art of refuse handling included the adaptation of such containers to be handled by lifting equipment. In particular, refuse containers were fitted with fork pockets so as to receive adjustable fork assemblies mounted to mobile refuse collection vehicles. By utilizing collection vehicles equipped with lifting forks, and servicing containers fitted with fork pockets, significant gains in speed, safety, and efficiency have been realized. However, an unintended consequence has been the noise resulting from the engagement of the container by the forks as well as the removal of refuse from the container when shaken (as is often times the case) to ensure that all debris has been removed.

A principal reason for the significant noise emanating from the container is the fact that the container is nearly always a hollow steel structure. Operational noises from both the vehicle and the container during refuse removal are amplified by the volume defined by the container. While constructing a container from different material may solve the noise problem, the process would likely have to be phased.

In view of the foregoing, it is desirable to incorporate a noise suppression scheme so that existing steel refuse containers can continue to be used but are modified to reduce the amplification and/or transmission of vibrations that occur during unloading of the container by a fork equipped vehicle.

BRIEF SUMMARY OF THE INVENTION

The invention is directed on the one hand to retrofitting existing containers that are adapted for use with vehicles having lifting forks for elevating and maneuvering such containers, as well as retrofitting the vehicle forks, and on the other hand to constructing new equipment to include the invention. An apparatus according to the invention comprises a liner formed from a vibration absorbing material for insertion into a pocket associated with a container. Alternatively to or in conjunction with the liner, either a glove formed from a vibration absorbing material can be inserted over a lifting fork on a fork bearing, lifting apparatus, or a rail formed from a vibration absorbing material can be fitted to at least a portion of a lifting fork on the fork bearing, lifting apparatus. In all cases, the liner or glove/rail is preferably constructed from a durable material having very low vibration transmission properties and/or high damping properties. The invention is also directed to methods relating to the use and incorporation of the apparatus, and systems incorporating more than one component thereof.

In a preferred embodiment, ultra high molecular weight (UHMW) polyethylene is chosen as the vibration absorbing material. However, it is to be noted that the invention includes metallic, non-metallic, and hybrid materials, with the ultimate selection criteria resulting in a reduction in vibration transmission between the container and the lifting equipment. Thus, a vibration absorbing material impregnated with metallic elements is within the scope of this invention as would be a laminate construction of metallic and non-metallic strips.

The liner and glove embodiments of the invention are preferably formed to frictionally fit, respectively, within an existing container pocket or over an existing lifting fork. While such a fit is sufficient to enable the invention (alternative means to secure the liner and/or glove are contemplated such as by use of adhesives, fasteners, and the like), each apparatus preferably includes means for preventing the separation of one or more apparatus from the supporting structure, to prevent the unintentional dislodgment of a liner or glove.

The liner embodiment of the invention is formed to have outer dimensions that are sufficient to frictionally fit, with or without additional treatment, within the container pocket, and internal dimensions sufficient to receive an intended lifting fork, with or without a glove. Thus a cylinder of material is formed by, for example extrusion or rotational molding, to specifically fit a given container pocket.

A feature of the liner is the presence of a lip that extends laterally beyond the cylinder at an end to prevent the liner from exiting the container pocket if pushed by an entering fork. Another feature of the invention is the presence of a bumper that extends unidirectionally from the cylinder at the lip. The bumper serves to insulate the container structure from any lifting fork supporting structure such as a cross member or similar element.

The glove embodiment of the invention is similarly formed to have specific dimensions based upon the structure to which it will be attached. In particular, the internal dimensions of the cylinder that comprises the glove are sufficient to fit over the targeted section of a lifting fork. If the lifting fork also includes a distal end cap, the glove is preferably heated so that it enlarges sufficiently to pass over the cap and returns to a nominal size after cooling.

In the rail embodiment, the lifting fork is preferably modified so as to receive the rail element yet preferably maintain its original dimensions. Thus, if the working length of the rail is 30"×1", a similarly sized segment of the load bearing portion of the fork is removed to receive the rail. A similar modification can be made with respect to the opposite or lower side of the lifting fork, depending upon design considerations.

A feature of the rail embodiment is a symmetrical or asymmetrical lateral enlargement of its width beyond the corresponding width of the lifting fork. In this manner, lateral movement of a container being engaged by the equipped lifting fork will be modulated by the vibration dampening rail as opposed to the lateral sides of the lifting fork, which do not have vibration dampening properties. Similarly, increased or decreased rail depths are also considered to be viable modifications.

In all embodiments, the internal and external surface characteristics may be other than smooth. Thus, the internal surface of the glove embodiment or the external surface of the liner embodiment may have a ribbed character to enhance the friction fit between these components and a fork or container pocket, respectively. Similarly, the exterior surface of the glove embodiment and the rail embodiment, or the internal surface of the liner embodiment may be ribbed.

DETAILED DESCRIPTION OF THE PREFERRED EMBODIMENTS

The following discussion is presented to enable a person skilled in the art to make and use the invention. Various modifications to the preferred embodiment will be readily apparent to those skilled in the art, and the generic principles herein may be applied to other embodiments and applications without departing from the spirit and scope of the present invention as defined by the appended claims. Thus, the present invention is not intended to be limited to the embodiment show, but is to be accorded the widest scope consistent with the principles and features disclosed herein.

Figure 1:
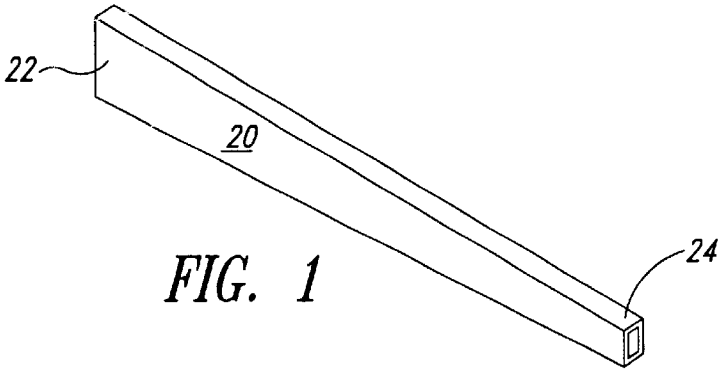
FIG. 1 is a perspective view of a glove embodiment in accordance with principles of the present invention for covering a fork component associated with a refuse transportation vehicle.
Figure 2:
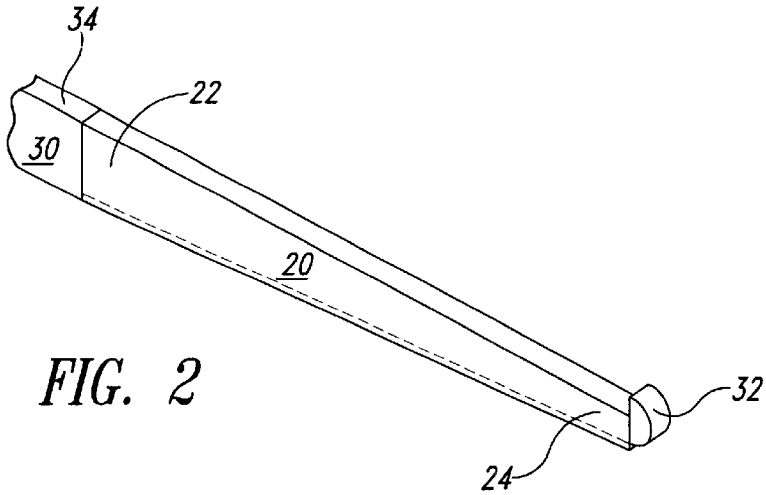
FIG. 2 is a perspective view of the glove of FIG. 1 shown mounted to a fork having an end cap for securing the glove on the fork in accordance with principles of the present invention.

Turning to the several Figures wherein like numerals indicate like parts, and more particularly to FIGS. 1 and 2, fork glove 20 is shown. Glove 20 includes trailing portion 22 and leading portion 24, and is preferably constructed from 0.375 inch (0.9525 cm) UHMW polyethylene and is sized to frictionally fit over a target fork (as shown in FIG. 1), which dimensions may vary from application to application. Thus, the inner dimensions of glove 20 are nominally the same as the exterior dimensions of fork 30 shown in FIG. 2. Stated alternatively, any given lifting fork will have a progressive cross-sectional profile, which may or may not vary along the length of the lifting fork. The glove will have an inner cross-sectional profile complementary to that of the lifting fork when located thereon at a specific location, thus insuring a sufficient friction fit. And while a preferred means for attaching glove 20 to fork 30 is by way of a friction fit, other means for securing glove 20 to fork 30 are contemplated: adhesives, all forms of threaded fasteners, blind side fasteners, and mechanic constrictors such as clamps.

Alternatives to UHMW polyethylene include hard rubber, polytetrafluoroethylene (PTFE), or any other durable and vibration absorbing material. Vibration absorbing properties and wear resistance are the most significant design parameters for selecting a suitable material. Consequently, most resilient yet durable materials are considered to be suitable for use. Moreover, materials capable of plastic deformation are desired for reasons set forth below.

The method of constructing glove 20 is largely a design consideration. Examples of construction methods include rotational molding, clam molding and extrusion molding.

In selected applications, distal lifting fork end cap 32 may be part of fork 30 as is shown in FIG. 2. In such instances, end cap 32 incidentally operates to retain glove 20 on fork 30 should the frictional fit or other fastening means fail. It is to be noted, however, that leading portion 24 of glove 20 is prevented from forward movement by abutting end cap 32 while rearward movement is prevented by the frictional fit between trailing portion 22 of glove 20 against fork 30. Thus, the entire glove need not be in frictional engagement with the fork in order for the invention to function as desired.

To install glove 20, it is only necessary to insert trailing portion 22 over the target fork and urge it rearward thereon. Depending upon tolerances, it may be desirable and/or necessary to heat glove 20 to ensure it securely stays in its intended location, or to heat leading portion 24 of glove 20 to permit end cap 32 to pass there through, whereafter glove 20 is allowed to cool to its original form. Any heating operation such as by convection, conduction or radiation is suitable, as long as there is not permanent deformation of glove 20.

Figure 3:
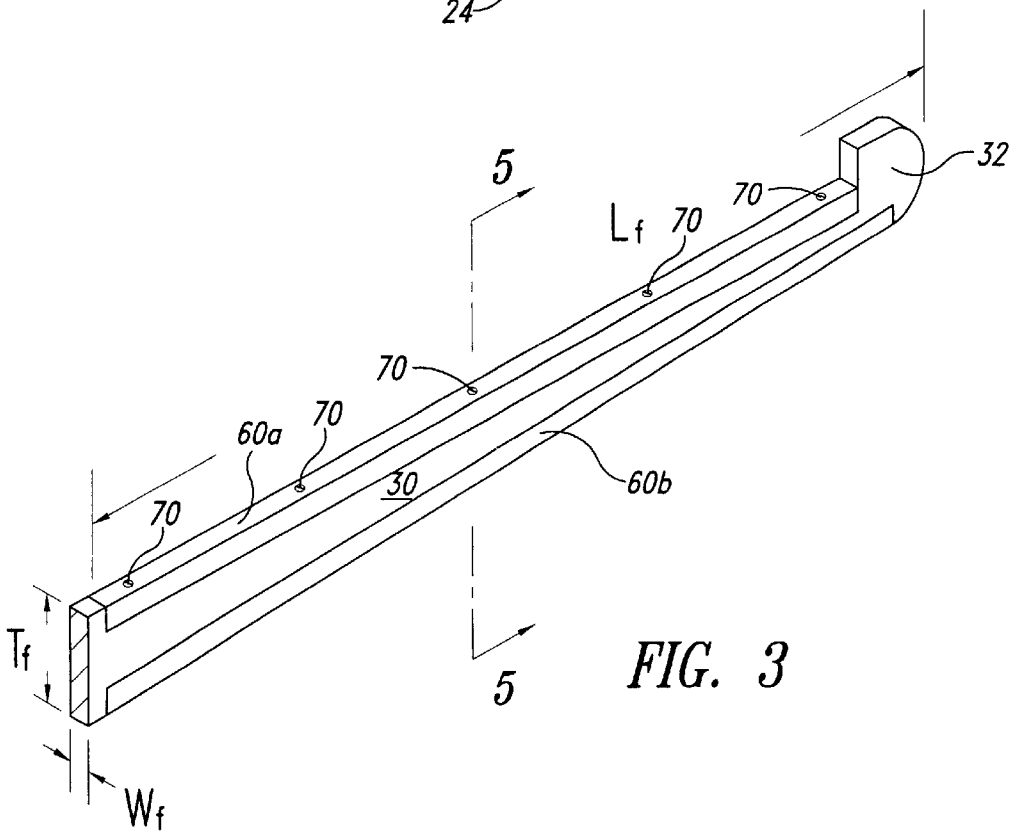
FIG. 3 is a perspective view of a fork modified to receive a rail embodiment as an alternative to the glove embodiment in accordance with principles of the present invention.

Heretofore all surfaces of fork 30 have been enveloped by vibration dampening material. An alternative means for insulating fork 30 is shown in FIG. 3. Instead of a glove that encompasses the upper and lower surfaces as well as the inside and outside surfaces, rail 60*a* is substituted for a portion of upper surface 34 and rail 60*b* is substituted for a portion of lower surface 36. Each rail 60*a* and 60*b* is also constructed of UHMW polyethylene, PTFE or hard rubber, which are again considered vibration absorbing materials, and may be formed by extrusion or other suitable means. Each rail 60*a* and 60*b* preferably has a sectional thickness of about 1 inch (2.54 cm) and resides in a corresponding complementary recess 42 and 46 formed in fork 30. The creation of recesses 42 and 46 may occur during construction of new forks, or may be created as a retrofit application using conventional material removal means. While this embodiment preferably uses both rails 60a and 60b, noise mitigation can be achieved by only using one or the other, and preferably rail 60*a*.

Even though there are no absolute limits for the maximum sectional thickness ($T_r$) of either rail 60*a* or 60*b*, there are practical limits. For example, a thickness less than 0.25 inches may not provide the durability and insulative properties that are desired, while a thickness greater than 25% of the sectional thickness of fork 30 may compromise the structural integrity of the fork when the recess is formed. Consequently, ultimate determination of rail thickness is a design consideration.

The width ($W_r$) of either rail 60*a* or 60*b* is selectable depending upon the desired effect. If lateral movement of a container pocket about fork 30 is to be addressed, the width of one or both rails can be modified to exceed the fork width for any given location. To avoid unintended contact between the pocket and a leading portion of a rail, it is advisable to have the leading portion of a rail not exceed the fork width at such a location. Thus, preferably a rail width may exceed fork 30 width at any location trailing the leading portion of a rail. In such an embodiment, the rail incorporates a taper or has a symmetrical or asymmetrical lateral convex contour.

Figure 4:
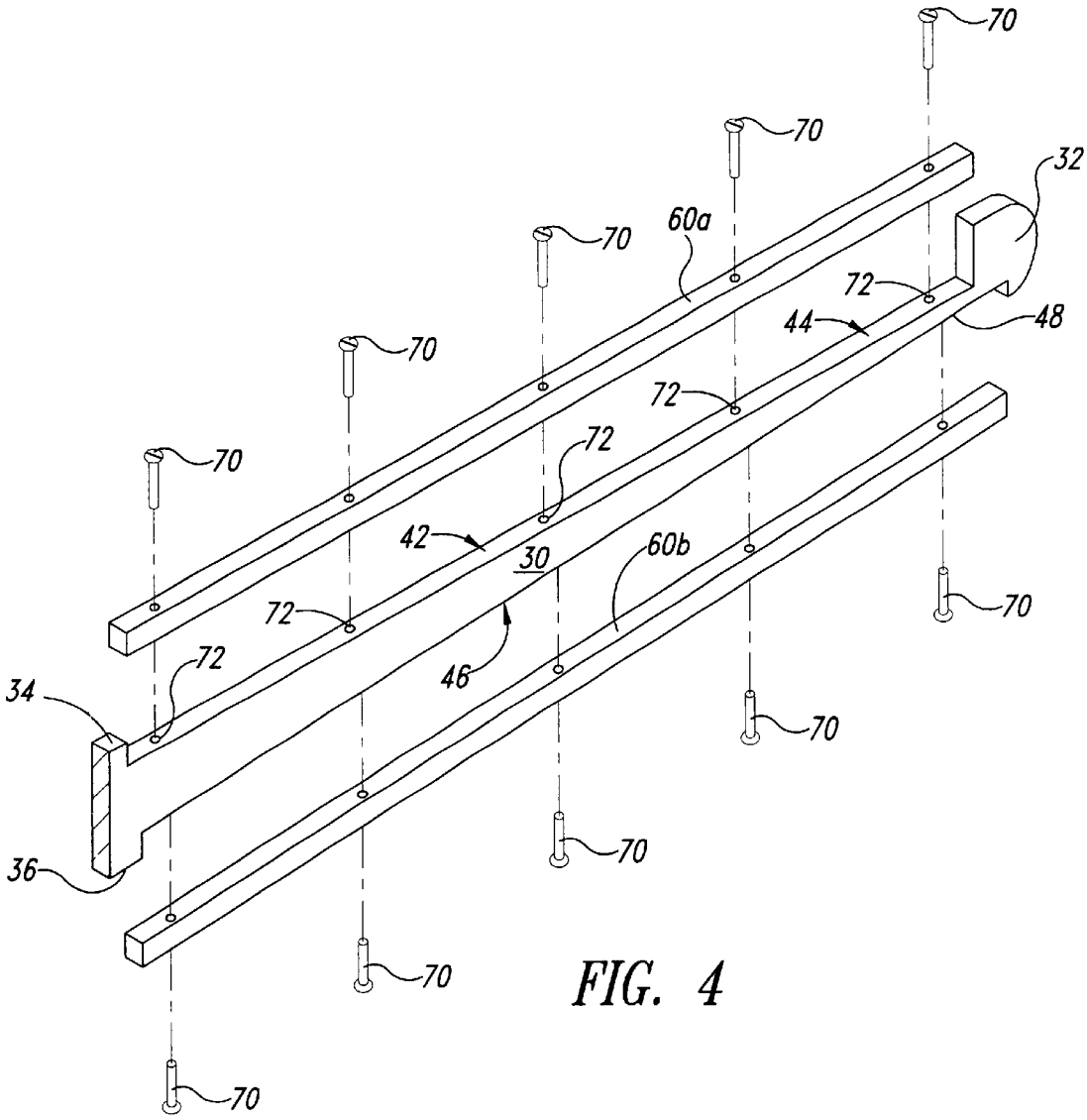
FIG. 4 is an exploded perspective view of the rail embodiment of FIG. 3 in accordance with principles of the present invention.
Figure 5:
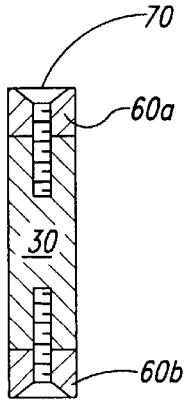
FIG. 5 is a representative cross section elevation view of the rail embodiment of FIG. 3 in accordance with principles of the present invention.

FIGS. 4 and 5 illustrate the modifications necessary to make fork 30 as well as one means for attaching each rail 60*a* and 60*b* to fork 30 (such as by way of machine screws 70 locatable in threaded holes 72). Other means for securing rail 60*a* and/or rail 60*b* to fork 30 exist, and include use of adhesives, all forms of threaded fasteners, blind side fasteners, and the like.

Figure 6:
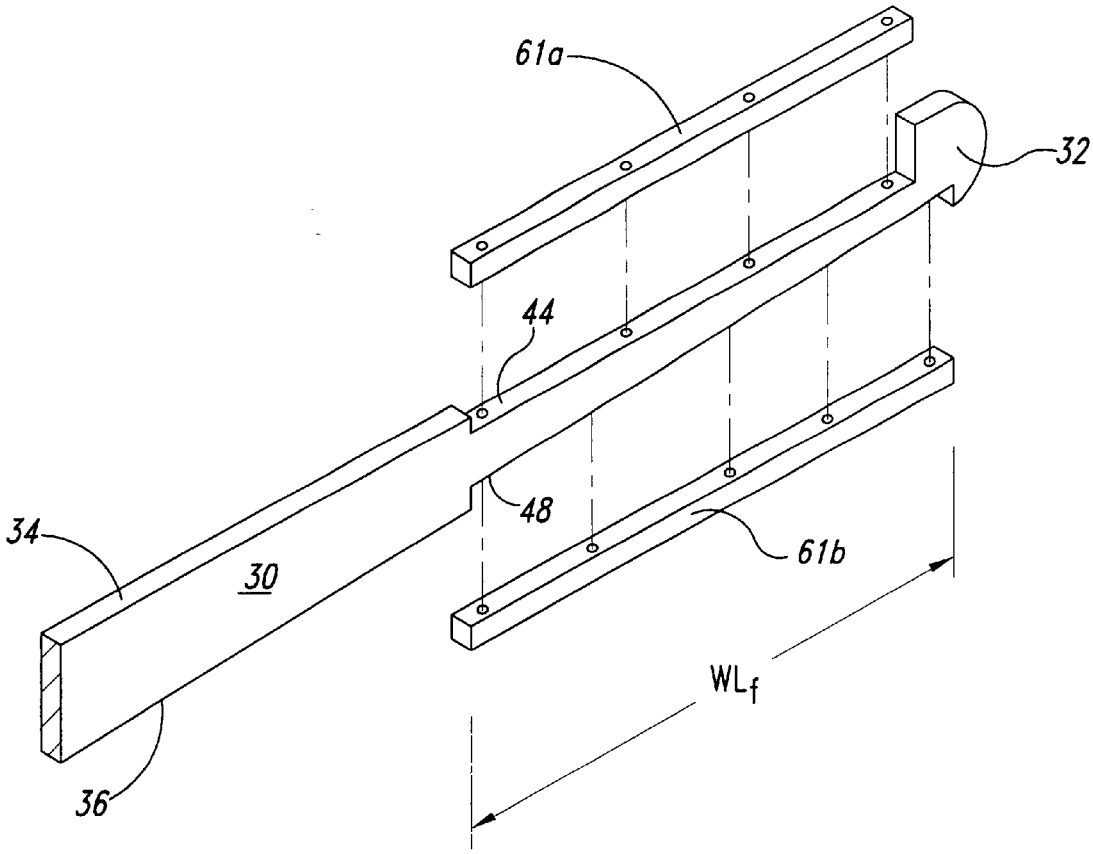
FIG. 6 is an exploded perspective view of an alternative rail embodiment to that shown in FIG. 3 in accordance with principles of the present invention.

FIG. 6 illustrates an alternative embodiment of the present invention. Through experimentation, it has been determined that significant noise mitigation can be achieved if only the front or leading working portions of fork 30 are modified to include corresponding rails 61*a* and 61*b*. Thus, only a portion of each upper and lower working length "$LW_f$" of fork 30 has a corresponding forward upper recess 44 and forward lower recess 48 to which are fastened respectively rails 61*a* and 61*b*. This embodiment is best shown in FIG. 6. Again, because the areas of fork 30 that are exposed to the highest levels of impact loading benefit the most from use of the instant technology, incorporation of upper rail 61*a* is more desirable than relying solely on lower rail 61*b*.

Figure 7:
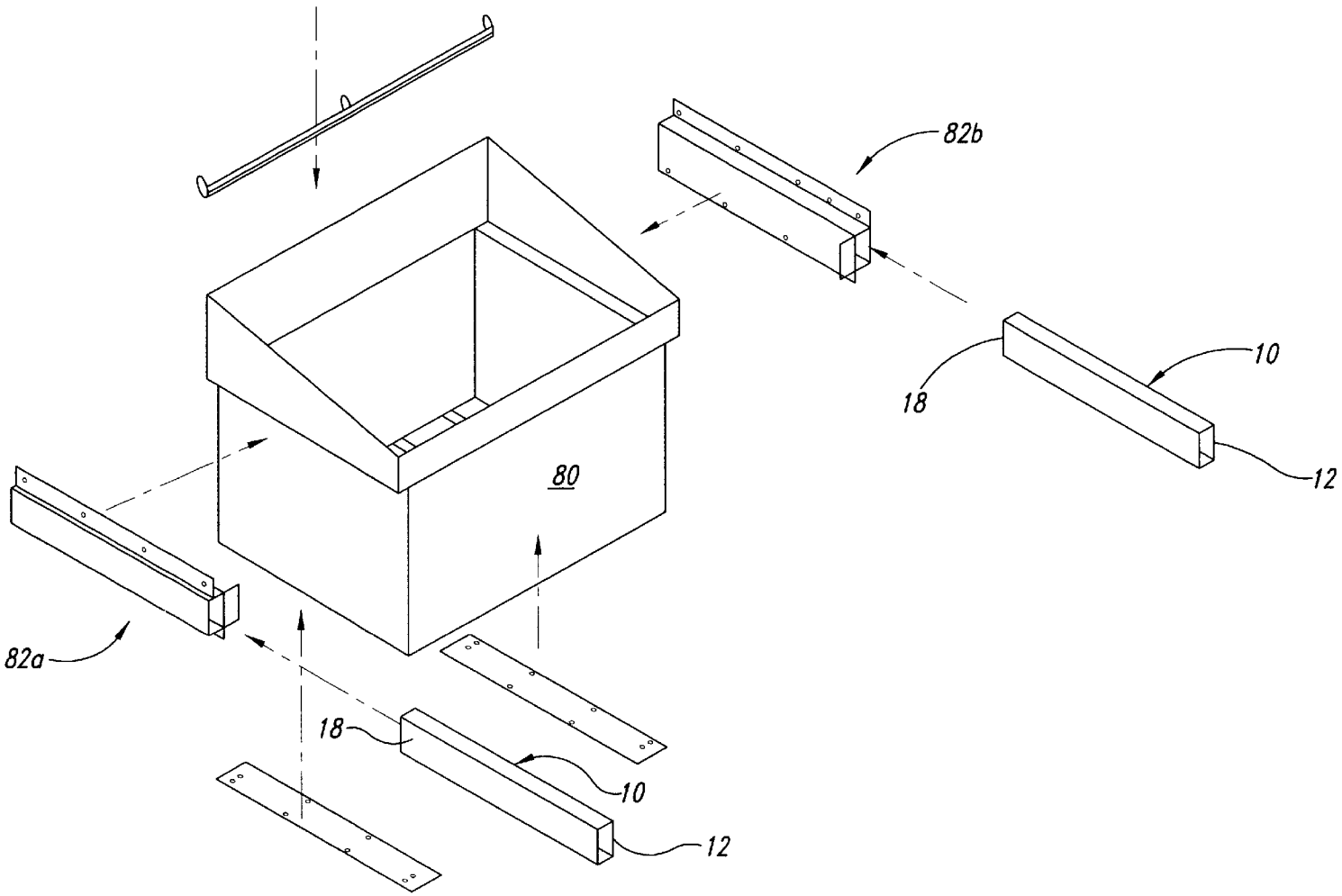
FIG. 7 is an exploded perspective view of a refuse container showing a liner and illustrating the placement of the liner in the pockets of the container in accordance with principles of the present invention.

The foregoing discussion related to modifications that can be made to fork 30. The invention is also directed to means for modifying an existing container to achieve noise mitigation. To this end, properly oriented liner 10, which is best shown in FIG. 7, is inserted into pockets 82*a* and 82*b* of container 80 as illustrated. Each pocket 82*a* and 82*b* will have a progressive cross-sectional profile that may or may not vary over its length. In order to have a frictional fit between a pocket and a liner, the liner should have an outer complementary progressive cross-sectional profile. As with glove 20, liner 10 is preferably constructed from 0.375 inch UHMW polyethylene.

Pockets 82*a* and 82*b* are shown as being symmetrical (mirror images), therefore only one type of liner 10 is needed. Liner 10 includes a proximal end 12 and a distal end 18. To install liner 10, it is only necessary to insert distal end 18 into pocket 82*a* or 82*b* and urge it rearward. However, if asymmetric pockets are encountered, it will be necessary to fabricate a unique liner for each pocket, as those persons skilled in the art will appreciate.

Figure 8:
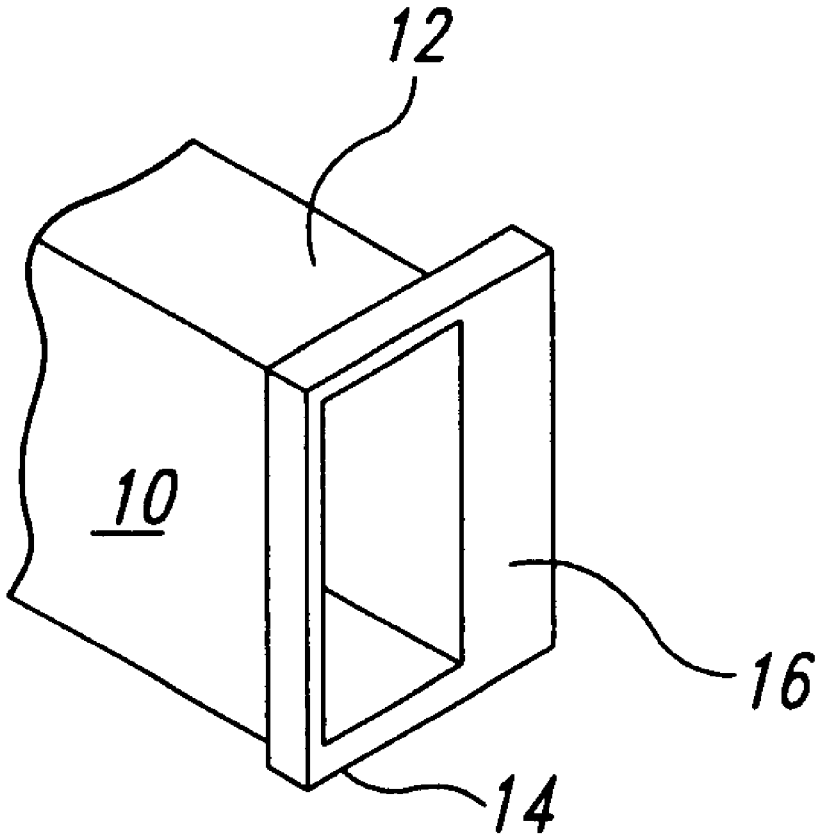
FIG. 8 is a partial perspective view of the front portion of a liner highlighting a lip to prevent unintended forward movement of the liner in the pocket and a bumper to reduce impact during insertion of a fork assembly.

As shown in FIG. 8, a feature of a preferred embodiment is lip 14 extending around the periphery of proximal end 12. Because lip 14 has outer dimensions greater than the inner dimensions of pocket 82*a* or 82*b*, rearward translation of liner 10 is thereby prevented. While lip 14 represents a presently preferred means for preventing such unintentional movement, other means are contemplated such as the use of adhesives between the inner portions of pocket 82*a* or 82*b* and the outer portions of liner 10 and/or fasteners which attach pocket 82 with liner 10. These other means may also be used in conjunction with lip 14.

As further shown in FIG. 8, another feature of liner 10 is the presence of bumper 16. Not only is vibration and hence noise produced by a fork 30 interacting with a pocket 82, but also when container 80 abruptly contacts a fork support assembly. To this end, distal end 18 extends from lip 14 so as to create a barrier between container 80 around the inlet of each pocket 82*a* and 82*b*.

The above description of illustrated embodiments of the invention is not intended to be exhaustive or to limit the invention to the precise form disclosed. While specific embodiments of, and examples for, the invention are described herein for illustrative purposes, equivalent modifications are possible within the scope of the invention, as those skilled within the relevant art will recognize. The teachings provided herein of the invention can be applied to other container systems, not necessary the exemplary containers described above. The various embodiments described above can be combined to provide further embodiments.

These and other changes can be made to the invention in light of the above detailed description. In general, in the following claims, the terms used should not be construed to limit the invention to the specific embodiments disclosed in the specification and the claims, but should be construed to include all container systems and lifting apparatus that operate under the cranes to provide a method and a system for mitigating noise during unloading, loading or movement of containers. Accordingly, the invention is not limited by the disclosure, but instead the scope of the invention is to be determined entirely by the following claims.

What is claimed is:

1. A rail for use with a lifting fork, the lifting fork having a maximum working length between a distal end and a proximal end, a maximum width and a maximum sectional thickness, wherein the fork includes an upper working surface and a lower working surface, and wherein a portion of the upper working surface has been removed to define a recess having the sectional depth, the rail including a length of vibration absorbing material dimensioned to at least substantially occupy the upper working surface recess wherein the vibration absorbing material mitigates noise during loading and unloading operations of a container.

2. The rail according to claim 1 having a sectional thickness approximately equal to the sectional depth of the recess over the length of the recess.

3. The rail according to claim 1 having a maximum width equal to or less than the maximum working width of the fork over the length of the recess.

4. The rail according to claim 1 having a maximum width greater than the maximum working width of the fork.

5. The rail according to claim 4 wherein the maximum width occurs between a leading end and a trailing end of the rail.

6. The rail according to claim 1 wherein the recess has a length less than the maximum working length of the fork.

7. The rail according to claim 1 wherein the recess has a length equal to or less than 60% of the maximum working length of the fork and is proximate to the leading end.

8. The rail according to claims 1 wherein the recess is formed subsequent to the manufacture of the lifting fork.

9. The rail according to claim 1 wherein the rail is secured at least partially to the lifting fork by a fastening means selected from the group consisting of a friction fit, a threaded fastener, an adhesive, and a constriction element.

10. The rail according to claim 1 wherein a portion of the lower working surface has been removed to define a recess having the sectional depth and further comprising a second rail having a length of vibration absorbing material dimensioned to at least occupy the lower working surface recess.

11. The rail according to claim 10 having a sectional thickness approximately equal to the sectional depth of the recess over the length of the recess.

12. The rail according to claim 10 having a maximum width equal to or less than the maximum working width of the fork over the length of the recess.

13. The rail according to claim 10 having a maximum width greater than the maximum working width of the fork.

14. The rail according to claim 13 wherein the maximum width occurs between a leading end and a trailing end of the rail.

15. The rail according to claim 10 wherein the recess has a length less than the maximum working length of the fork.

16. The rail according to claim 10 wherein the recess has a length equal to or less than 60% of the maximum working length of the fork and is proximate to the leading end.

17. The rail according to claim 10 wherein the recess is formed subsequent to the manufacture of the lifting fork.

18. The rail according to claim 10 wherein the rail is secured at least partially to the lifting fork by a fastening means selected from the group consisting of a friction fit, a threaded fastener, an adhesive, and a constriction element.

19. The rail according to claim 1 wherein at least one surface of the rail has a surface selected from the group consisting of a smooth surface, a corrugated surface, a cross-hatched surface, a surface having protrusions, and a surface having dimples.

20. A glove for use with a lifting fork, the lifting fork having a progressive cross-sectional profile, a maximum working length between a distal end and a proximal end, a maximum width and a maximum sectional thickness, wherein the fork includes an upper working surface and a lower working surface, the glove comprising:

a cylinder constructed from a vibration absorbing material having an inner progressive cross-sectional profile complementary to the cross-sectional profile of the fork and a length, and defining an interior volume having a width wherein the cylinder length less than or equal to the maximum working length of the fork.

21. The glove of claim 20 wherein the inner progressive cross-sectional profile of the cylinder causes the glove to achieve a friction fit with the lifting fork when engaged therewith.

22. The glove of claim 20 wherein the inner progressive cross-sectional profile of the cylinder causes the glove to achieve a friction fit at the proximal end thereof with the lifting fork when engaged therewith.

23. The glove of claim 20 wherein the glove is secured at least partially to the lifting fork by a fastening means selected from the group consisting of a friction fit, a threaded fastener, an adhesive, and a constriction element.

24. The glove of claim 20 wherein the inner surface of the cylinder is selected from the group consisting of a smooth surface, a corrugated surface, a cross-hatched surface, a surface having protrusions, and a surface having dimples.

25. A composite lifting fork comprising:

a lifting fork having a maximum working length between a distal end and a proximal end, a maximum width and a maximum sectional thickness, wherein the fork includes an upper working surface and a lower working surface, and wherein a portion of the upper working surface has been removed to define a first recess having the sectional depth; and a first rail attachable to the fork and occupying the first recess wherein the rail is constructed from a vibration absorbing material.

26. The composite lifting fork of claim 25 wherein the first recess and the first rail have a length substantially equal to the maximum working length of the fork.

27. The composite lifting fork of claim 25 wherein the first recess and the first rail have a length less than or equal to the maximum working length of the fork.

28. The composite lifting fork of claim 25 wherein at least a portion of the first rail has a width greater than or equal to the maximum working width of the fork.

29. The composite lifting fork of claim 25 wherein at least a portion of the first rail has a depth greater than or equal to the sectional depth of the recess.

30. The composite lifting fork of claim 25 where a portion of the lower working surface has been removed to define a recess having the sectional depth, and further comprising a second rail attachable to the fork and occupying the second recess wherein the rail is constructed from a vibration absorbing material.

31. A sleeve insert for a pocket-bearing container, the pocket having an internal progressive cross section, including a height and an internal width at any given point along its length, the insert comprising:

a cylinder constructed from a vibration absorbing material and having a progressive external cross section substantially complementary to the progressive cross section of the container pocket, and having a front portion periphery, a rear portion, an upper wall, a lower wall, an inside wall and an outside wall.

32. The sleeve insert of claim 31 further comprising a lip portion extending from at least a portion of the front portion periphery wherein the lip portion extends at least unidirectionally beyond the external sectional dimensions of the container pocket when the sleeve is inserted therein.

33. The sleeve insert of claim 32 wherein the lip portion extends from all portions of the front portion periphery.

34. The sleeve insert of claim 31 further comprising a bumper extending from at least a portion of the front portion periphery.

35. The sleeve insert of claim 32 further comprising a bumper extending from at least a portion of the lip portion.

36. The sleeve insert of claim 31 wherein the walls contacting the container pocket when installed have a surface selected from the group consisting of a smooth surface, a corrugated surface, a cross-hatched surface, a surface having protrusions, and a surface having dimples.

37. A method for mitigating noise events generated during movement of a container having at least one pocket by a lifting apparatus having at least one lifting fork engagable with the at least one pocket, comprising:

inserting a pocket liner constructed from a vibration absorbing material into the at least one pocket.

* * * * *

UNITED STATES PATENT AND TRADEMARK OFFICE

CERTIFICATE OF CORRECTION

PATENT NO. : 6,632,064 B1 
DATED : October 14, 2003
INVENTOR(S) : Steve Walker and John d'Arc Lorenz It is certified that error appears in the above-identified patent and that said Letters Patent is hereby corrected as shown below:

Title page,
Item [54], "METHOD AND APPARATUS TO MITIGATE NOISE DURING UNLOADING OF REFUSE CONTAINERS" should read as -- METHOD, APPARATUS AND SYSTEM TO MITIGATE NOISE DURING UNLOADING OF CONTAINERS --
Item [56], References Cited, U.S. PATENT DOCUMENTS, the following should also be listed:
-- 5,221,176 06/22/93 Allen et al. --

Column 6,
Line 44, "claims 1" should read as -- claim 1 --

Signed and Sealed this

Tenth Day of August, 2004

JON W. DUDAS
*Acting Director of the United States Patent and Trademark Office*